US006935141B2

(12) United States Patent
Takeda et al.

(10) Patent No.: US 6,935,141 B2
(45) Date of Patent: Aug. 30, 2005

(54) SOCKS AND METHOD OF MANUFACTURING THE SOCKS

(75) Inventors: Susumu Takeda, Fujimi (JP); Masaru Kuroiwa, Nagano (JP)

(73) Assignee: Takea Leg Wear Co., Ltd., Saitama-ken (JP)

( * ) Notice: Subject to any disclaimer, the term of this patent is extended or adjusted under 35 U.S.C. 154(b) by 0 days.

(21) Appl. No.: 10/488,948

(22) PCT Filed: Sep. 6, 2002

(86) PCT No.: PCT/JP02/09133

§ 371 (c)(1),
(2), (4) Date: Mar. 9, 2004

(87) PCT Pub. No.: WO03/022083

PCT Pub. Date: Mar. 20, 2003

(65) Prior Publication Data

US 2004/0261466 A1 Dec. 30, 2004

(30) Foreign Application Priority Data

Sep. 10, 2001 (JP) ..... 2001-274032
Sep. 10, 2001 (JP) ..... 2001-274039

(51) Int. Cl.[7] ..... D04B 9/46
(52) U.S. Cl. ..... 66/187
(58) Field of Search ..... 2/239, 241; 66/185, 66/186, 187

(56) References Cited

U.S. PATENT DOCUMENTS 1,452,302 A * 4/1923 Loven ..... 2/239
3,128,763 A * 4/1964 Langenfeld et al. ..... 2/239
6,000,247 A * 12/1999 Takeda et al. ..... 66/187
6,381,755 B2 * 5/2002 Cortani ..... 2/239

FOREIGN PATENT DOCUMENTS

JP 8-35152 A 2/1996
JP 9-296302 A 11/1997
JP 10-46405 A 2/1998
JP 11-21703 A 1/1999

* cited by examiner

*Primary Examiner*—Danny Worrell
(74) *Attorney, Agent, or Firm*—Birch, Stewart, Kolasch & Birch, LLP

(57) ABSTRACT

Asymmetrical hosiery (10) knitted by a hosiery knitting machine, wherein a tip position (G) of a tip top part (14) is positioned nearer to a big toe side (16), characterized in that a first gusset part (22) is knitted nearer to the big toe side (16) of the tip toe section (14) so as to near a shape of a human foot having a big toe thicker and longer than other toes so that bulge of the tip toe section (14) on the big toe side (16) can be made larger than that of a little toe side (18), and that a second gusset part (24) is knitted nearer to the big toe side (16) following the first gusset part (22) so as to extend the big toe side (16) without substantially extending the little toe side (18) of the tip toe section (14).

9 Claims, 12 Drawing Sheets

SOCKS AND METHOD OF MANUFACTURING THE SOCKS

FIELD OF TECHNOLOGY

The present invention relates to hosiery and a method of manufacturing hosiery, more precisely relates to hosiery knitted by a hosiery knitting machine and method of manufacturing the hosiery.

BACKGROUND TECHNOLOGY

A conventional sock 100 shown in FIG. 12 is manufactured by cylindrically knitting a cylindrical knitted part 106*a* from an inlet part toward a heel section 102, and knitting the heel section 102. Further, a cylindrical knitted part 106*b* is cylindrically knitted from the heel section 102 toward a tip toe section 104, then an opening formed in an instep part of the cylindrical knitted part 106*b* is seamed to finish the sock. In FIG. 12, the seamed opening is shown as a seam line 108.

The sock 100 shown in FIG. 12 is manufactured by, for example, a circular knitting machine having a needle holder, in which a plurality of knitting needles are provided on an outer circumferential face of a needle holder which is capable of rotating in a prescribed direction and turning in a normal direction and a reverse direction so as to knit the sock. As shown in FIG. 13A, the knitting needle has a hook section 52, which is formed at a front end, and a tongue section 54, whose one end is pivotably attached to a neck part of the hook section 52 by a shaft 56 so as to open and close the hook. As shown in FIG. 13B, the needle holder has a cylindrical member 62 and a plurality of longitudinal grooves 64, 64, . . . formed in the outer circumferential face, the knitting needles 50 shown in FIG. 13A are respectively inserted in the grooves 64 and capable of moving upward and downward. By rotating the needle holder 60 in the prescribed direction, the knitting needles 50 are moved upward in order at a prescribed position so as to knit the sock.

The sock 100 shown in FIG. 12, which has been manufactured by the knitting machine including the needles shown in FIG. 13A and the needle holder shown in FIG. 13B, is symmetrically formed, so that the sock can be put on a right foot and a left foot.

However, the sock 100 shown in FIG. 12 has the symmetrical tip toe section 104; if it is put on an asymmetrical human foot, whose tip top is positioned nearer to a big toe side and which has a big toe thicker and longer than other toes, cloth of the sock is pulled by the big toe so that the big toe and a little toe of the person are pressed.

To solve the problem of pressing the toes caused by the sock 100 shown in FIG. 12, one of the inventors invented hosiery shown in FIGS. 14A–14C, which was disclosed as U.S. Pat. No. 6,000,247.

A tip toe section 204 of a sock 200 shown in FIGS. 14A–14C has an asymmetrical shape, in which a tip position G is shifted on a big toe side with respect to a center line X and in which a gusset part 220 for making bulge of the tip toe section 204 on the big toe side larger than that of the little toe side is knitted nearer to the big toe side of the tip toe section 204.

FIG. 14A shows the tip toe section 204 seen from an instep side of the sock 200, wherein a seam line 208 is formed on the instep section of the sock 200. FIG. 14B shows the tip toe section 204 seen from a front end side of the sock 200, and FIG. 14C shows the tip toe section 204 seen from a sole part side of the sock 200.

Note that, the gusset part 220 of the sock 200 shown in FIGS. 14A–14C is constituted by a gusset part 220*a* of the sole part and a gusset part 220*b* of the instep section.

DISCLOSURE OF THE INVENTION

The shape of the sock 200 having the tip toe section 204 is similar to that of the foot, whose big toe is thicker than other toes, so that foot comfort of the sock is better than that of the sock 100 shown in FIG. 12.

However, in the tip toe section 204 shown in FIGS. 14A–14C, a length of the big toe side of the tip toe section 204, which is equal to a distance from a border between the tip toe section 204 and the sole part 206*a* or the instep section 206*b* (the widest portion of the tip toe section 204) to the tip position G, i.e., a distance between the seam line 208 and the tip position G, is too short for a foot whose big toe is longer than a little toe.

To improve foot comfort of the sock 200 for the foot whose big toe is thicker and longer than other toes, it is necessary to locate the tip position G of the tip toe section 204 on the big toe side and to extend the distance between the seam line 208 and the tip position G so as to correspond to the big toe side of the foot.

However, if the tip position G is located on the big toe side and the distance between the seam line 208 and the tip position G is extended with maintaining the shape of the tip toe section 204 shown in FIGS. 14A–14C (with maintaining similarity), the shape becomes the tip toe section 204' shown in FIG. 15, wherein a length of the little toe side of the tip toe section 204' (a distance between an outermost edge of an inlet section, from which a foot is inserted, and the seam line 208) is also elongated as well as the big toe side. Therefore, when the sock having the tip toe section 204' is put on, cloth is slacken off on the little toe side, so that foot comfort is not good.

On the other hand, if the distance between the edge of the big toe side of the tip toe section 204 and the seam line 208 is elongated with limiting elongation of the distance between an edge on the little toe side and the seam line 208, the shape becomes the tip toe section 204" shown in FIG. 15, wherein the tip position G of the tip toe section 204" is close to the center line X so that the shape of the tip toe section 204" becomes a symmetrical shape. Therefore, by putting on the sock having the tip toe section 204" , the big toe and the little toe are pressed, so that foot comfort is not good.

When the sock having the tip toe section shown in FIGS. 14A–14C is put on, an inner ankle part and an outer ankle part of the heel section are pulled, so that foot comfort of the sock is made worse and cloth of the ankle parts are apt to be damaged.

A first object of the present invention is to provide hosiery, whose shape is similar to a human foot having a big toe thicker and longer than other toes and which has good foot comfort, and a method of manufacturing the hosiery.

A second object of the present invention is to provide hosiery, which has good foot comfort for walking and which is capable of preventing cloth of an inner ankle part and an outer ankle part of a heel section from damaging, and a method of manufacturing the hosiery.

The inventors of the present invention has studied to achieve the first and the second objects and found that: by forming a first gusset part, which makes bulge on a big toe side larger than that of a little toe side, and a second gusset part, which is knitted nearer to the big toe side following the first gusset part, in a tip toe section, length of the big toe side and the little toe side of the tip toe section can be corresponded to those of a human foot with maintaining a tip position of the tip toe section nearer to the big toe side; and by forming a gusset part nearer to one side of a heel section, the hosiery has good foot comfort for walking and is capable of preventing cloth of an inner ankle part and an outer ankle part of a heel section from damaging, so that the inventors invented the present invention capable of achieving the first and the second objects.

Namely, the first object is achieved by asymmetrical hosiery knitted by a hosiery knitting machine, wherein a tip position of a tip top part is positioned nearer to a big toe side, characterized in, that a first gusset part is knitted nearer to the big toe side of the tip toe section so as to near a shape of a human foot having a big toe thicker and longer than other toes so that bulge of the tip toe section on the big toe side can be made larger than that of a little toe side, and that a second gusset part is knitted nearer to the big toe side following the first gusset part so as to extend the big toe side without substantially extending the little toe side of the tip toe section.

A method for achieving the first object is a method of manufacturing hosiery knitted by a hosiery knitting machine, wherein a tip toe section of the hosiery is knitted with shifting a knitting direction of the hosiery knitting machine toward a big toe side of the tip toe section so that a first gusset part, which makes bulge of the tip toe section on the big toe side larger than that of a little toe side, and a second gusset part, which is knitted nearer to the big toe side following the first gusset part so as to extend the big toe side without substantially extending the little toe side of the tip toe section, are knitted near to the big toe side.

The second object is achieved by hosiery knitted by a hosiery knitting machine, wherein an asymmetrical heel section includes a fourchett part positioned nearer to one side of the heel section, and an edge of said fourchett part locates at the one side of the heel section when the person wear said hosiery.

A method for achieving the second object is a method of manufacturing hosiery knitted by a hosiery knitting machine, wherein a heel section of the hosiery is knitted with shifting a knitting direction of the hosiery knitting machine toward one side of the heel section so that a gusset part is knitted near to the one side of the heel section.

In the hosiery for achieving the first object, a front end part of the tip toe section may be constituted by the second gusset part, and a big toe side face of the tip toe section may be constituted by the first gusset part and the second gusset part; with this structure, the big toe side of the tip toe section can be further thicker and longer than other toes thereof so that the shape of the tip toe section can be similar to the human foot.

Further, edges of the first gusset part and the second gusset part may form V-shaped lines, whose distance is gradually made longer toward a front end of the big toe side, when a big toe side of the tip toe section is seen from a side, and the edges forming the V-shaped lines may be arranged toward a front end of the big toe side; with this structure, the first and the second gusset parts can be easily made by the knitting machine, and the shape of the tip toe section can be further similar to the human foot.

In the hosiery, an asymmetrical heel section may include a third fourchett part positioned nearer to one side of the heel section, and an edge of the third fourchett part may locate at the one side of the heel section when the person wear the hosiery; with this structure, the hosiery can have good foot comfort for walking and is capable of preventing cloth of the inner ankle part and the outer ankle part of the heel section from damaging.

The first fouchett part and the second fourchett part may be knitted with changing number of actually knitting needles of the knitting machine; with this method, the first fouchett part and the second fourchett part can be easily knitted and located nearer to the big toe side of the tip toe section.

The hosiery achieving the first object has the a first gusset part, which is knitted nearer to the big toe side of the tip toe section so as to make the bulge of the tip toe section on the big toe side larger than that of the little toe side, and the second gusset part, which is knitted nearer to the big toe side following the first gusset part so as to extend the big toe side without substantially extending the little toe side of the tip toe section.

With this structure, the bulge of the tip toe section on the big toe side can be made larger than that of the little toe side, and length of the big toe side and the little toe side can be corresponded to those of the human foot with maintaining the tip position nearer to the big toe side by forming the second gusset part.

Therefore, the shape of the hosiery can be similar to the human foot whose big toe is thicker and longer than other toes, and the hosiery has good foot comfort.

The heel section of the conventional hosiery has the symmetrical shape, but the shape of the heel section of the human foot has an asymmetrical shape. When a person puts on the conventional symmetrical hosiery, the cloth of the inner ankle part or outer ankle part is pulled so that foot comfort is made worse and the cloth of the heel section is damaged.

In the hosiery achieving the second object, the gusset part is knitted one-sided or the edge of the fourchett part locates at the one side of the heel section, so that the heel section is asymmetrically formed. With this structure, extension of the cloth of the inner or outer ankle part of the heel section, which occurs when a person puts on the hosiery achieving the second object, can be eased, foot comfort can be improved and damaging the cloth of the heel section can be prevented.

OPTIMUM EMBODIMENTS OF THE INVENTION

Figure 1A:
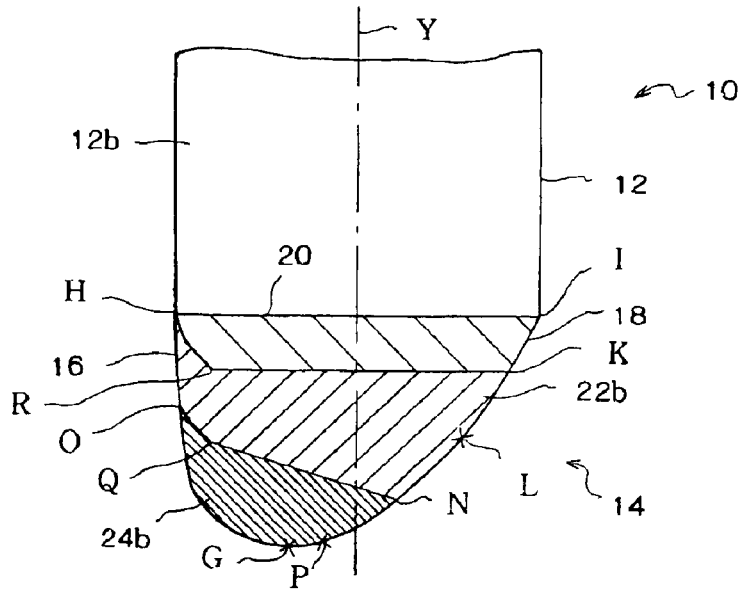
FIGS. 1A–1C are explanation views of a sock relating to the present invention.
Figure 1B:
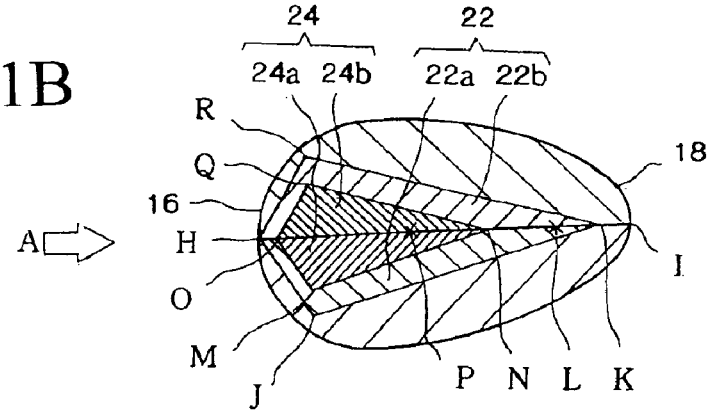
Figure 1C:
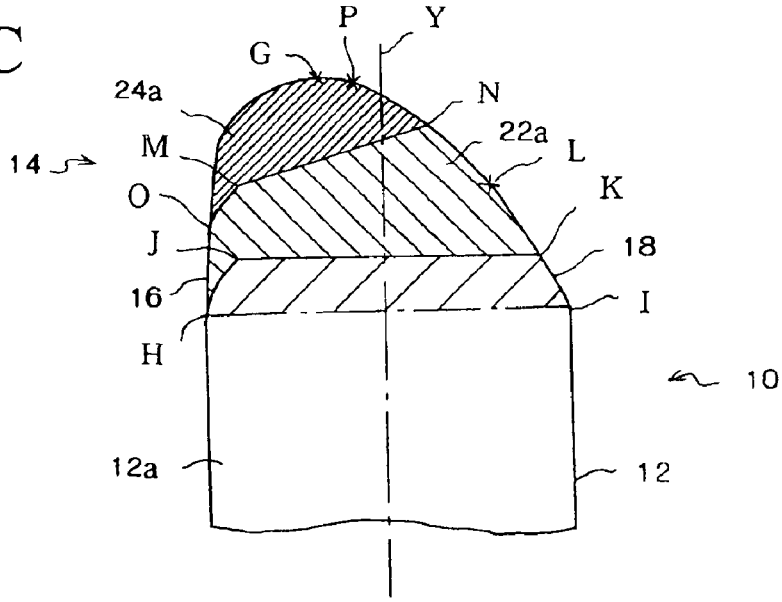

An example of a tip toe section of a sock relating to the present invention is shown in FIGS. 1A–1C. FIG. 1A shows the tip toe section 14 of a sock 10 for a left foot, in which a cylindrical knitted part 12 is seen from an instep part 12*b* side, and a seam line 20 is formed in the instep part 12*b*. FIG. 1B shows the tip toe section 14 of the sock 10 seen from a tip toe side, and FIG. 1C shows the tip toe section 14 of the sock 10, in which the cylindrical knitted part 12 is seen from a sole part 12*a* side.

In the tip toe section 14 of the sock 10 shown in FIGS. 1A–1C, a left side of the tip toe section 14 is a big toe side 16 covering a big toe of a human foot; a right side of the tip toe section 14 is a little toe side 18 covering a little toe of the human foot.

As shown in FIGS. 1A and 1C, the tip toe section 14 of the sock 10 has an asymmetrical shape, in which a tip position G is shifted nearer to the big toe side 16 with respect to a center line Y. The shape is similar to the shape of the human foot.

As shown in FIG. 1B, the tip toe section 14 of the sock 10 has a first gusset part 22, which is knitted nearer to the big toe side 16 of the tip toe section 14, and a second gusset part 24 is knitted nearer to the big toe side 16 following the first gusset part 22.

As to the first gusset part 22 and the second gusset part 24, bulge of the tip toe section 14 on the big toe side 16 is made larger than that of the little toe side 18 by the first gusset part 22 as shown in FIG. 1B; the big toe side 16 of the tip toe section 14 is extended without substantially extending the little toe side 18 by the second gusset part 24 as shown in FIGS. 1A and 1B.

With this structure, the sock 10 shown in FIGS. 1A–1C has the asymmetrical shape, in which the tip position G of the tip toe section 14 is located nearer to the big toe side 16 and which is similar to the human foot having the big toe thicker and longer than other toes, so that foot comfort of the sock can be better than that of the sock 200 shown in FIG. 14.

The first gusset part 22 is integrally constituted by a sole side part 22*a* of the first gusset part and an instep side part 22*b* of the first gusset part; the second gusset part 24 is integrally constituted by a sole side part 24*a* of the second gusset part and an instep side part 24*b* of the second gusset part.

In the tip toe section 14 shown in FIGS. 1A–1C, the tip position is included in the second gusset part 24, and a side face of the big toe side 16 of the tip toe section 14 is constituted by the first gusset part 22 and the second gusset part 24. In the sock 10, the big toe side 16 of the tip toe section 14 can be further thicker and longer than the little toe side 18, so that the shape of the tip toe section can be further similar to that of the human foot.

When the tip toe section 14 of the sock 10 is seen from the big toe side 16 [or seen from a direction of an arrow A shown in FIG. 1B], edges of the first gusset part 22 and the second gusset part 24 make V-shaped lines, whose distance is gradually made longer toward the front end of the tip toe section 14 and which form the bulge of the big toe side 16.

Further, the edges of the first gusset part 22 and the second gusset part 24 forming the V-shaped lines are arranged, in order, toward the front end of the tip toe section 14, and the length of the big toe side 16 is longer than that of the little toe side 18.

Figure 13A:
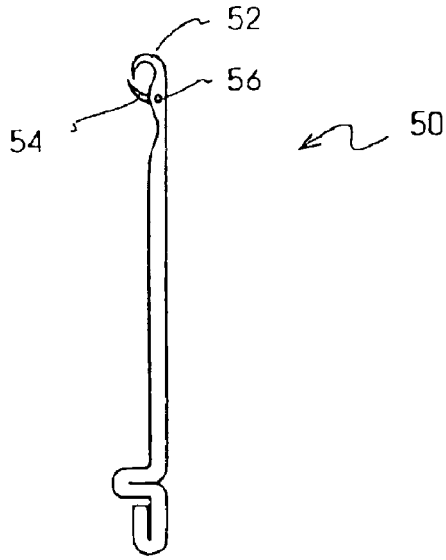
FIGS. 13A and 13B are explanation views of the circular sock knitting machine.
Figure 13B:
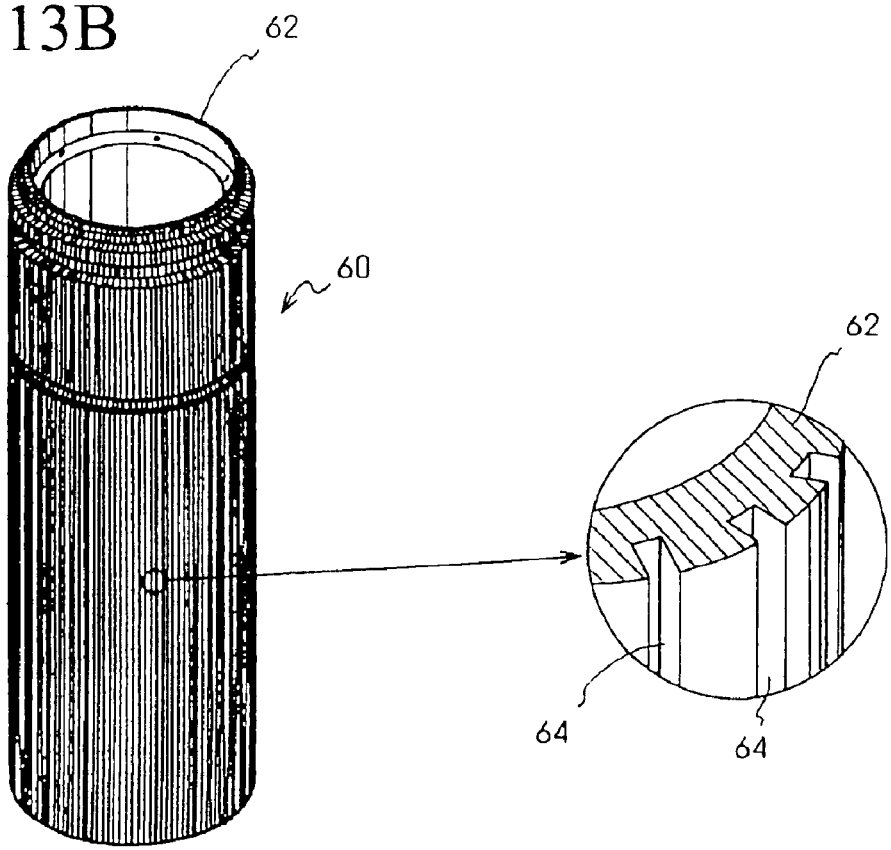

The sock 10 shown in FIGS. 1A–1C can be knitted by a known circular knitting machine shown in FIGS. 13A and 13B.

When the tip toe section 14 of the sock 10 is knitted, a knitting direction of the needle holder 60 of the circular knitting machine is shifted toward the big toe side of the tip toe section 14, so that the first gusset part 22, which makes the bulge of the tip toe section 14 on the big toe side 16 larger than that of the little toe side, and the second gusset part 24, which is knitted nearer to the big toe side 16 following the first gusset part 22 so as to extend the big toe side 16 without substantially extending the little toe side 18 of the tip toe section 14, are knitted near to the big toe side.

Namely, firstly the needle holder 60 of the circular knitting machine is rotated in a prescribed direction until the cylindrical knitted part 12 having a prescribed length is knitted, then the needle holder 60 is alternately turned in one direction and the reverse direction with changing number of the actually knitting needles 50 until the tip toe section 14 of the sock 10 is knitted. The change of the number of the actually knitting needles 50 is performed when the turning direction of the needle holder 60 is changed.

When the tip toe section 14 is knitted, firstly the section is knitted until reaching a position H-I shown in FIG. 1C, which shows a sole side part 12*b* of the cylindrical knitted part 12 of the sock 10, then the section is further knitted with gradually reducing the number of the actually knitting needles 50 (the number of the needles) until reaching a position J-K. Note that, number of reducing the needles while the needle holder 60 is turned in one direction and number of reducing the needles while the needle holder is turned in the reverse direction are substantially equal.

After reaching the position J-K, the needle holder 60 is turned toward the position J, and the tip toe section is knitted with gradually increasing the number of the needles until reaching the position H; and the needle holder 60 is turned toward the position K, and the tip toe section is knitted with gradually reducing the number of the needles until reaching a position L.

After reaching the position H-L, the tip toe section is knitted with gradually reducing the number of the needles until reaching a position M-N. Note that, number of reducing the needles while the needle holder 60 is turned in one direction and number of reducing the needles while the needle holder is turned in the reverse direction are substantially equal.

By knitting from the position J-K to the position M-N with turning the needle holder 60 and changing the number of the needles, the knitting direction can be shifted toward the big toe side 16 of the sock 10. Therefore, the sole side part 22*a* of the first gusset part can be knitted in the sole part 10*a* of the tip toe section 12 and located nearer to the big toe side 16.

After reaching the position M-N, the needle holder 60 is turned toward the position M, and the tip toe section is knitted with gradually increasing the number of the needles until reaching a position O; and the needle holder 60 is turned toward the position N, and the tip toe section is knitted with gradually reducing the number of the needles until reaching a position P. Therefore, the sole side part 24*a* of the second gusset part, which follows the sole side part 22*a* of the first gusset part, can be knitted and located nearer to the big toe side 16. The position O is located between the positions M and H.

After reaching the position O-P, the needle holder 60 is further turned toward the position O, and the tip toe section is knitted with gradually reducing the number of the needles until reaching a position Q; and the needle holder 60 is turned toward the position P, and the tip toe section is knitted with gradually increasing the number of the needles until reaching the position N. By knitting from the position O-P to the position Q-N, an instep side part 24*b* of the second gusset part can be formed and integrated with a sole side part 24*b* so as to form the second gusset part 24.

After reaching the position Q-N, the tip toe section is further knitted with gradually increasing the number of the needles until reaching the position H-L. Note that, number of increasing the needles while the needle holder 60 is turned in one direction and number of increasing the needles while the needle holder is turned in the reverse direction are substantially equal.

A track of an end of the needle holder 60 turning toward the position Q is extended to the position H via the position O.

After reaching the position H-L, the needle holder 60 is turned toward the position H, and the tip toe section is knitted with gradually reducing the number of the needles until reaching a position R; and the needle holder 60 is turned toward the position L, and the tip toe section is knitted with gradually increasing the number of the needles until reaching the position K. By knitting from the position Q-N to the position R-K, an instep side part 22*b* of the first gusset part, which follows the instep side part 24*b* of the second gusset part, can be formed and integrated with the sole side part 22*a* of the first gusset part so as to form the first gusset part 22.

After reaching the position R-K, the needle holder 60 is turned, and the tip toe section is knitted with gradually increasing the number of the needles until reaching the position H-I. Note that, number of increasing the needles while the needle holder 60 is turned in one direction and number of increasing the needles while the needle holder is turned in the reverse direction are substantially equal.

The position H-I is an open end of the knitted part in the instep part 12*b* of the sock 10, and the open end is seamed so that the seam line 20 is formed therein.

Loops of edges of the knitted parts, which constitute the tip toe section 14, are mutually tangled, so that the edges are mutually connected and constitute connected lines H-J, I-K, K-L-N, H-O-M, N-P, Q-O-H, and R-H. The connected lines correspond to ends of turning the needle holder 60.

The connected line Q-O-M corresponds to edges of the second gusset part 24, which constitutes a part of a front face and a side face of the big toe side 16, and the line is formed into a V-shape, whose is gradually made wider toward the front end of the big toe side 16, when the line is seen from the side of the big toe side 16 of the tip toe section 14 [or seen from a direction of an arrow A shown in FIG. 1B]. The connected line R-H-J corresponds to edges of the first gusset part 22, which constitutes a part of a side face of the big toe side 16, and the line is formed into a V-shape, whose is gradually made wider toward the front end of the big toe side 16, when the line is seen from the side of the big toe side 16 of the tip toe section 14 [or seen from the direction of the arrow A shown in FIG. 1B].

The V-shaped lines (the connected lines R-H-J and Q-O-M) of the first gusset part 22 and the second gusset part 24 are arranged, in order, toward the front end of the big toe side 16.

Note that, in the above described example shown in FIGS. 1A–1C, the expression "substantially equal" means that a difference between the number of increasing or reducing the needles while the needle holder is turned in one direction and the number of increasing or reducing the needles while the needle holder is turned in the reverse direction is 10% of the number of actually knitting needles or less.

Figure 2:
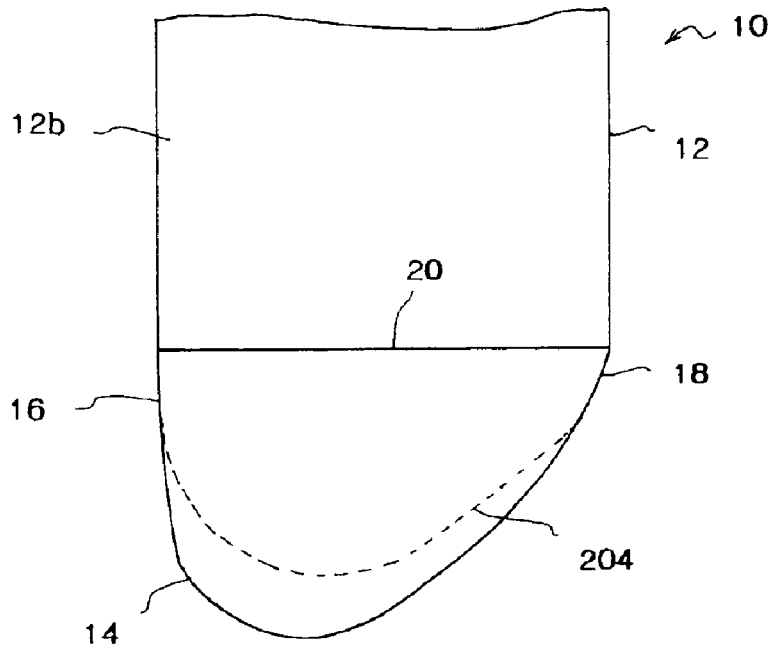
FIG. 2 is an explanation view explaining functions and effects of the sock.
Figure 14A:
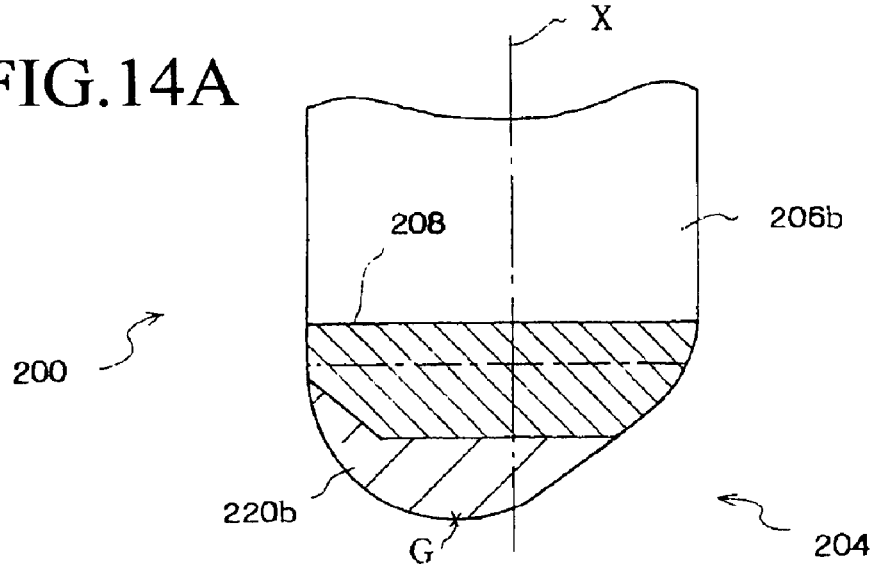
FIGS. 14A–14C are explanation view of another conventional sock modified the sock shown in FIG. 12.
Figure 14B:
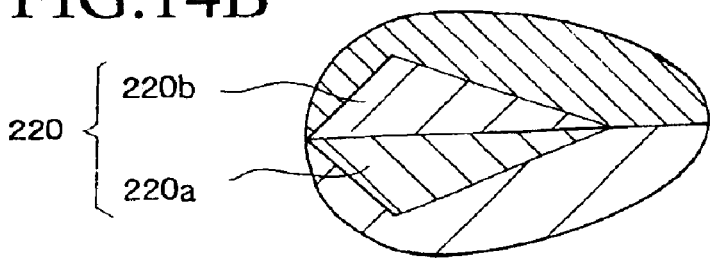
Figure 14C:
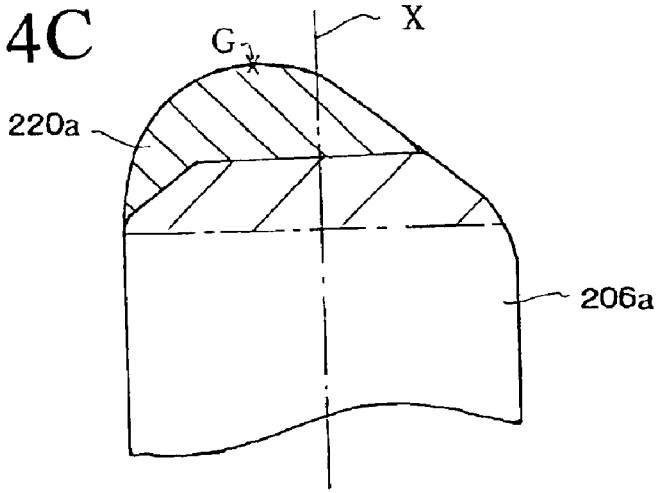
Figure 15:
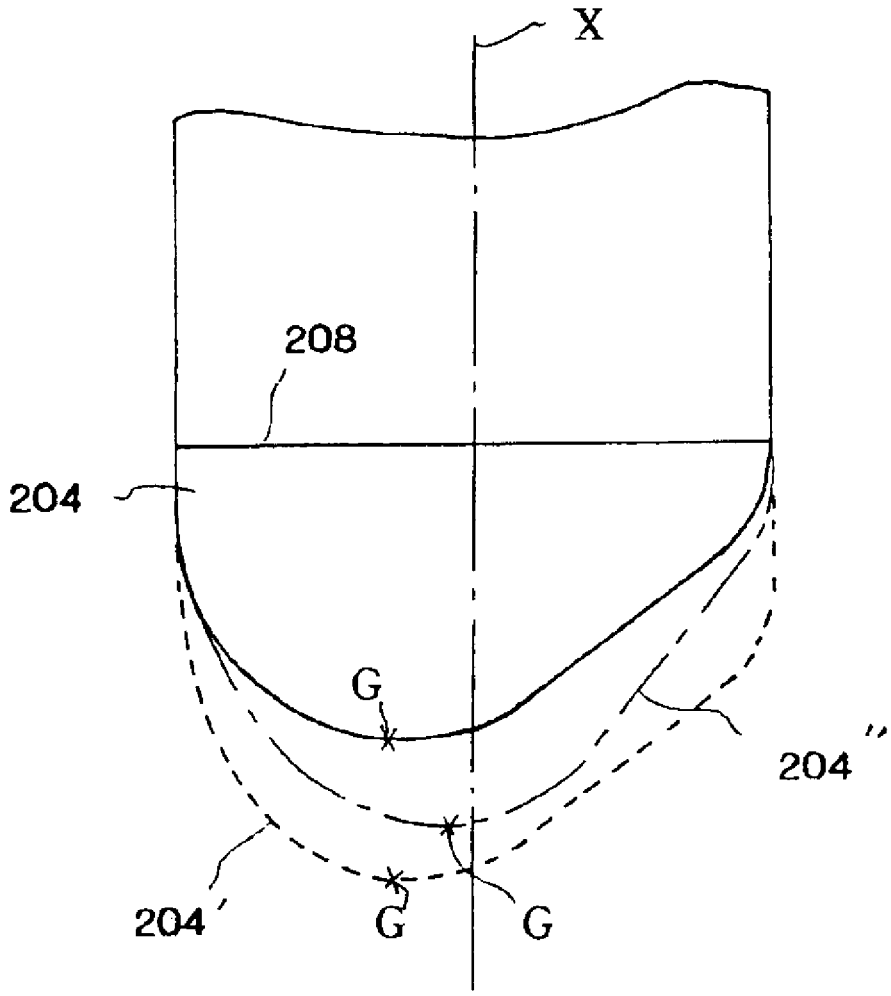
FIG. 15 is an explanation view explaining disadvantages of the tip toe section of the sock shown in FIG. 14.

Unlike the sock 200 shown in FIGS. 14A–14C, in the tip toe section 14 of the sock 10 shown in FIG. 2, the big toe side 16 can be extend without substantially extending the little toe side 14. In the sock 10 shown in FIGS. 1A–1C, the shape of the tip toe section 14 is similar to that of the human foot whose bit toe is thicker and longer than the other toes, and the big toe side 16 can be extended without slackening cloth in the little toe side 18 so that foot comfort can be highly improved.

Figure 3:
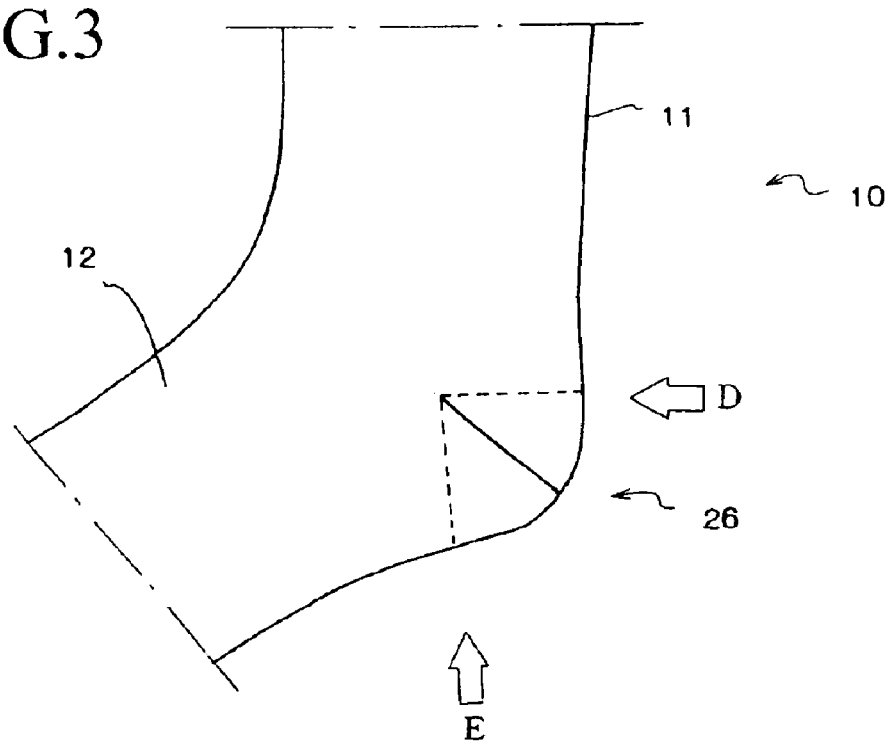
FIG. 3 is a partial side view of the sock shown in FIG. 1.
Figure 12:
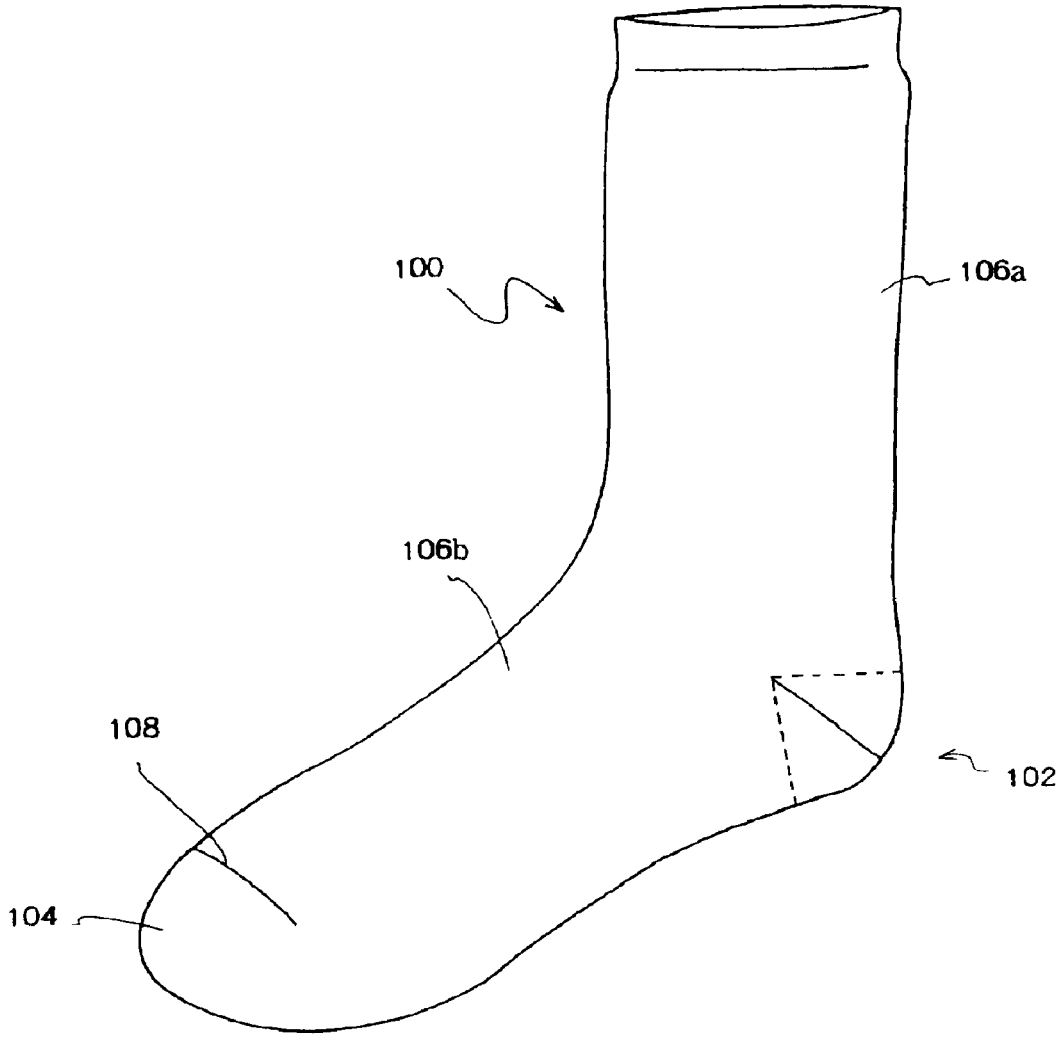
FIG. 12 is a perspective view of the conventional sock.

In the sock 10 shown in FIGS. 1A–1C and 2, as shown in FIG. 3, the heel section 26 is formed as well as the conventional sock 100 shown in FIG. 12. Namely, the heel section 26 is knitted by the circular knitting machine shown in FIG. 13, the cylindrical knitted part is knitted until reaching a position X-Y shown in FIG. 4A by rotating the needle holder 60 in a prescribed direction, then the needle holder 60 is alternately turned in one direction and the reverse direction with gradually reducing the number of the needles until reaching a position Z-W shown in FIG. 4A.

Figure 4A:
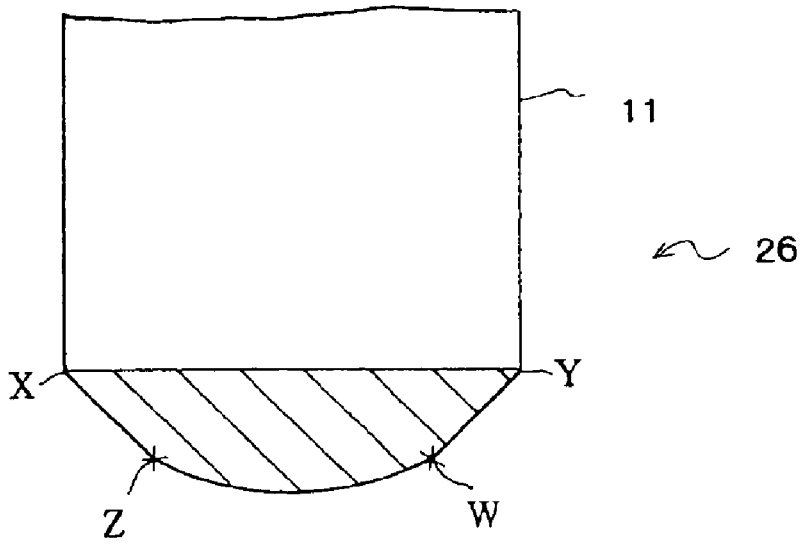
FIG. 4A is a side view of a heel section seen from a direction of an arrow D.
Figure 4B:
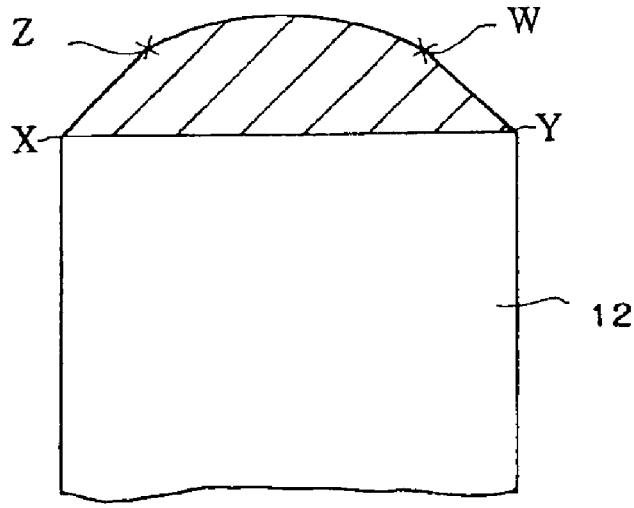
FIG. 4B is a side view of the heel section seen from a direction of an arrow E.

After reaching the position Z-W shown in FIG. 4A, the needle holder 60 is alternately turned in one direction and the reverse direction with gradually increasing the number of the needles until reaching the position X-Y shown in FIG. 4B, so that the heel section 26 can be knitted.

After reaching the position X-Y shown in FIG. 4B, the needle holder 60 is rotated in the prescribed direction with maintaining the number of the needles so as to knit the cylindrical knitted part 12.

With this method, the heel section 26 of the sock 10 has a symmetrical shape.

Figure 5:
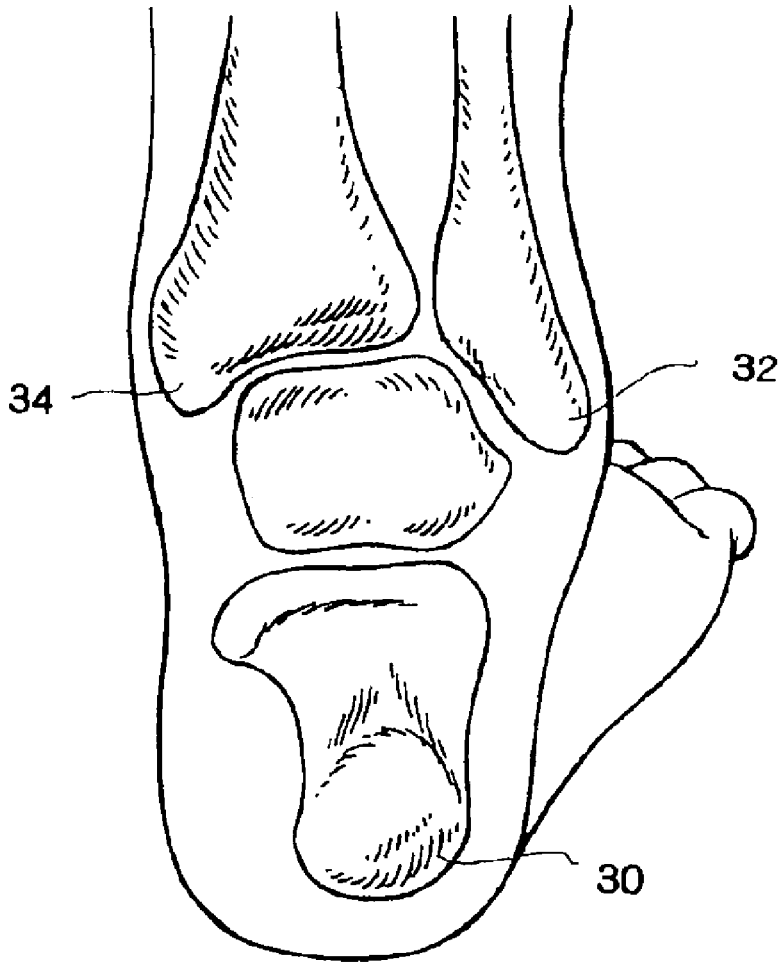
FIG. 5 is an explanation view showing a skeletal structure of a human leg.

A human foot looks like symmetrical, but, as shown in FIG. 5, a heel bone 30 is located nearer to an outer ankle bone (an outer ankle) 32, which is located at an lower end of a fibula, further an arch of foot is located nearer to an inner ankle bone (an inner ankle) 34, so that weight is concentrated to the outer ankle of the heel section 26 while walking.

Many people have X-shaped knock-knees or O-shaped bow-legs, so weight is concentrated to the outer ankle or the inner ankle of the heel section 26 while walking.

Therefore, if a person wears the socks 10 shown in FIGS. 3, 4A and 4B, whose heel sections 26 have symmetrical shapes, and walks, an outer ankle side or an inner ankle side of the heel section 26 of each sock 10 is pulled and tensed, so that foot comfort of the socks 10 become worse and cloth of the outer ankle side or the inner ankle side of the heel section 26 is damaged.

The shape of the tip toe section 14 is similar to that of the human foot whose big toe is thicker and longer than other toes, further the shape of the heel section 26 of the sock 10 similar to that of the human foot, so that foot comfort of the sock 10 can be further improved.

Figure 6A:
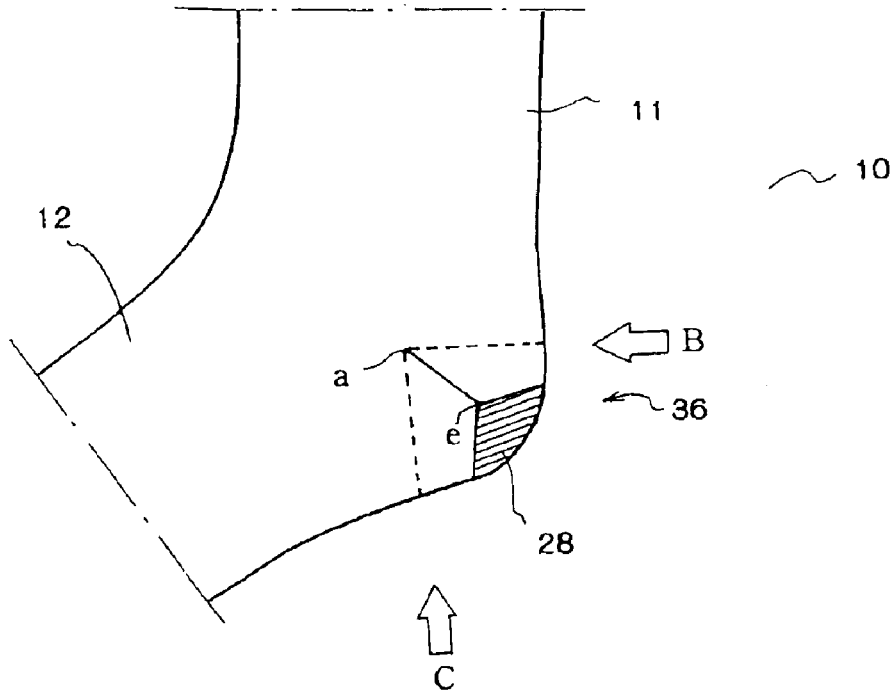
FIG. 6A is a side view of a heel section of a modified sock for a left foot seen from one side.
Figure 6B:
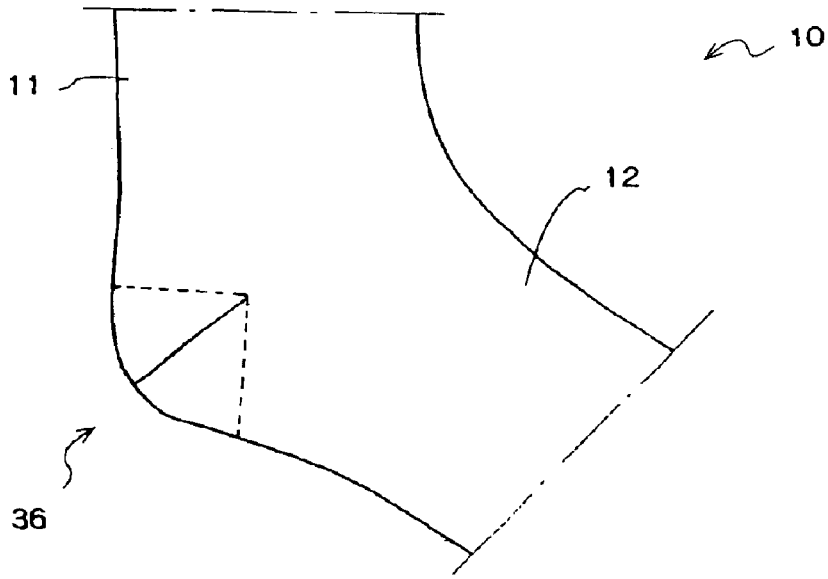
FIG. 6B is a perspective view of the heel section of the modified sock for the left foot seen from the other side.

An example of a heel section 36 whose shape is similar to that of a human foot is shown in FIGS. 6A and 6B. FIG. 6A is a partial side view of the heel section 36 of a sock 10 for a left foot seen from an outer ankle side, and FIG. 6B is a partial side view of the heel section 36 of the sock 10 for the left foot seen from an inner ankle side.

In the heel section 36 of the sock 10 shown in FIG. 6A, a third gusset part 28 is knitted nearer to the outer ankle side of the heel section 36 of the sock 10, and the third gusset part 28 in the heel section 36 is knitted to make an edge of the third gusset part 28 locate on the outer ankle side of the heel section 36 when the sock 10 is put on.

Note that, as shown in FIG. 6B, the edge of the third gusset part 28 is not seen from the inner ankle side of the heel section 36.

Figure 7A:
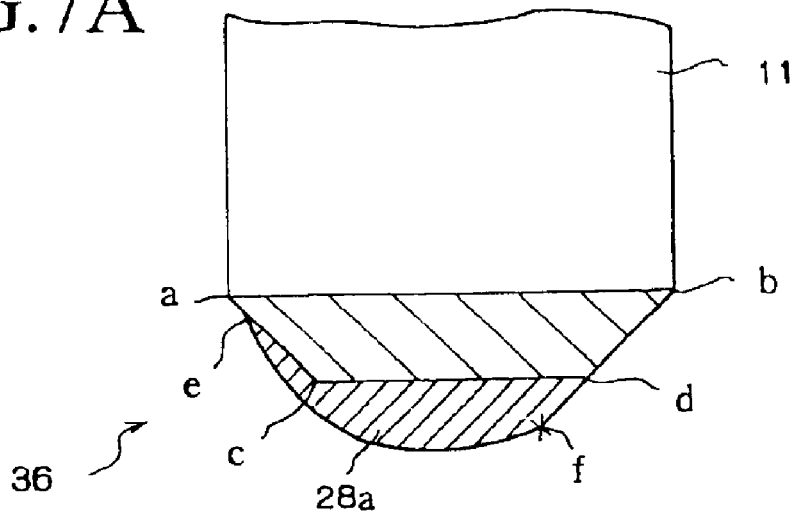
FIG. 7A is a partial side view of the heel section of the modified sock for the left foot seen from the direction of an arrow B shown in FIG. 6A.
Figure 7B:
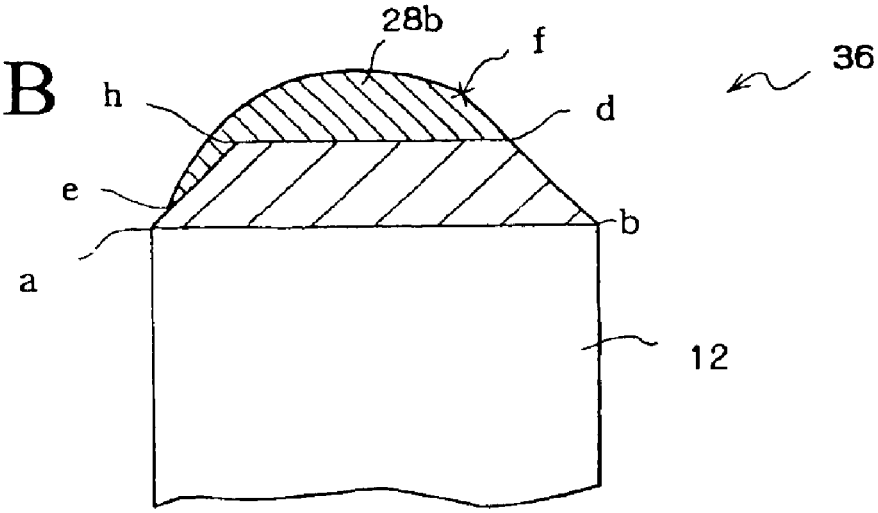
FIG. 7B is a partial bottom view of the heel section of the modified sock for the left foot seen from the direction of an arrow C shown in FIG. 6A.
Figure 8:
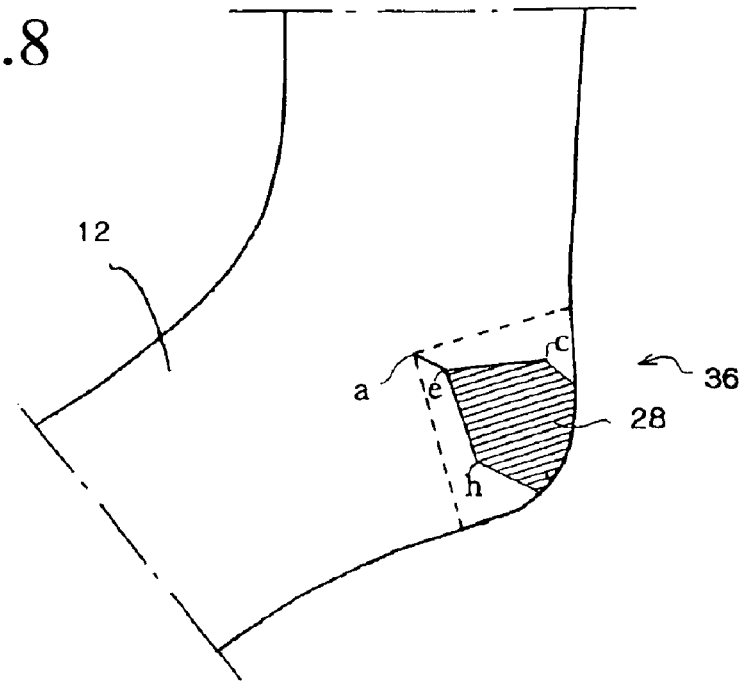
FIG. 8 is a partial perspective view of another example of the heel section of the modified sock for the left foot.

As to the heel section 36 shown in FIGS. 6A and 6B, a partial side view of the heel section 36 seen from a rear side [from the direction of an arrow B shown in FIG. 6A] is shown in FIG. 7A; a partial bottom view of the heel section 36 seen from a sole side [from the direction of an arrow C shown in FIG. 6A] is shown in FIG. 7B.

As clearly shown in FIGS. 7A and 7B, the third gusset part 28 is knitted in the heel section 36 of the sock 10 and located nearer to the outer ankle side. With this structure, the third gusset part 28, which has been knitted nearer to one side, makes a slackened cloth part on the outer ankle side of the heel section 36 of the sock 10.

Degree of tensing the cloth on the outer ankle side of the heel section 36, which is caused by the fibula 30 (see FIG. 5) which is located nearer to the outer ankle, can be relieved, so that foot comfort of the sock 10 is better than that of the sock 10 shown in FIGS. 3, 4A and 4B, which has the heel section 26, and damage of the cloth of the heel section 36 can be prevented.

The heel section 36 of the sock 10 shown in FIGS. 6A, 6B, 7A and 7B may be knitted by the circular knitting machine shown in FIGS. 13A and 13B, namely the knitting direction of the circular knitting machine is shifted toward the outer ankle side of the heel section 36 while knitting, so that the third gusset part 28 can be knitted nearer to the outer ankle side of the heel section 36.

A method of knitting the heel section 36, in which the third gusset part 28 is located nearer to the outer ankle side, with the circular knitting machine shown in FIGS. 13A and 13B will be explained with reference to FIGS. 7A and 7B.

Firstly the needle holder 60 of the circular knitting machine is rotated in a prescribed direction until a cylindrical knitted part 11 having a prescribed length is knitted, then the needle holder 60 is alternately turned in one direction and the reverse direction with changing number of the actually knitting needles of the needle holder 60 to knit the heel section 36. The change of the number of the actually knitting needles is performed when the turning direction of the needle holder 60 is changed.

When the heel section 36 is knitted by alternately turning the needle holder 60 with changing the number of the needles, after the needle holder 60 knitting the cylindrical knitted part 11 reaches a position a-b, the section is knitted until reaching a position c-d with gradually reducing the number of the needles. Note that, number of reducing the needles while the needle holder is turned in one direction and number of reducing the needles while the needle holder is turned in the reverse direction are substantially equal.

After reaching the position c-d, the needle holder 60 is turned toward the position c, and the heel section is knitted with gradually increasing the number of the needles until reaching a position e; and the needle holder 60 is turned toward the position d, and the heel section is knitted with gradually reducing the number of the needles until reaching a position f, so that the heel section 36 can be knitted with shifting the knitting direction toward the outer ankle side of the heel section. Therefore, a rear side part 28*a* of the third gusset part 28 can be knitted in a rear part of the heel section 36 and located nearer to the outer ankle side.

Further, the needle holder 60 is turned toward a position f, the heel section is knitted with gradually increasing the number of the needles until reaching the position d; and the needle holder 60 is turned toward the position e, and the heel section is knitted with gradually reducing the number of the needles until reaching a position h [see FIG. 7B], so that the heel section can be knitted with shifting the knitting direction toward the outer ankle side of the heel section 36. Therefore, a front side part 28*b* of the third gusset part 28 can be knitted in a front part of the heel section 36, and the whole third gusset part 28 is located nearer to the outer ankle side of the heel section 36.

After reaching the position h-d, the needle holder knits with gradually increasing the number of the needles until reaching the position a-b, so that the section 12 can be formed. When the needle holder knits from the position h-d to the position a-b, the number of increasing the needles while the needle holder 60 is turned in one direction and the number of increasing the needles while the needle holder is turned in the reverse direction are substantially equal.

The third gusset part may be formed by making knitted stitches of the prescribed part of the heel section 36 bigger than other parts of the heel section 36. The bigger stitches of the third gusset part can be extended easier than other parts of the heel section 36.

If the third gusset part 28 shown in FIGS. 6A, 6B, 7A and 7B is formed by the knitted stitches, which are bigger than stitches of other parts of the heel section 36, area of the third gusset part 28 can be small. The third gusset part 28, which is constituted by the knitted stitches bigger than stitches of other parts of the heel section 36, can be extended easier than other parts of the heel section 36.

Further, the sock 10, whose heel section 36 has the third gusset part 28, may have another gusset part, which is formed in any sections other than the heel section 12 of the sock 10 to which weight is applied during walk, another forchette part may be formed, for example, in a section between the heel section 12 and the tip toe section 14.

In the heel section 36 shown in FIGS. 6A, 6B, 7A and 7B, the third foruchetter part 28 is knitted nearer to the outer ankle side, but if weight is applied to the inner ankle side of the sock during walk and cloth of the inner ankle side is apt to be damaged, the third gusset part 28 may be knitted nearer to the inner ankle side.

The third gusset part 28 shown in FIGS. 6A, 6B, 7A and 7B is mostly formed on the sole side of the sock, but the edges (the connected lines e-c and e-h) of the V-shaped third gusset part 28 may be formed near the ankle so as to shift the whole third gusset part 28 toward the ankle. By forming the edges of the V-shaped third gusset part 28 near the ankle, the big third gusset part 28, which is bigger than the third gusset part 28 shown in FIG. 6A, can be formed in one side part of the heel section 36.

Figure 9:
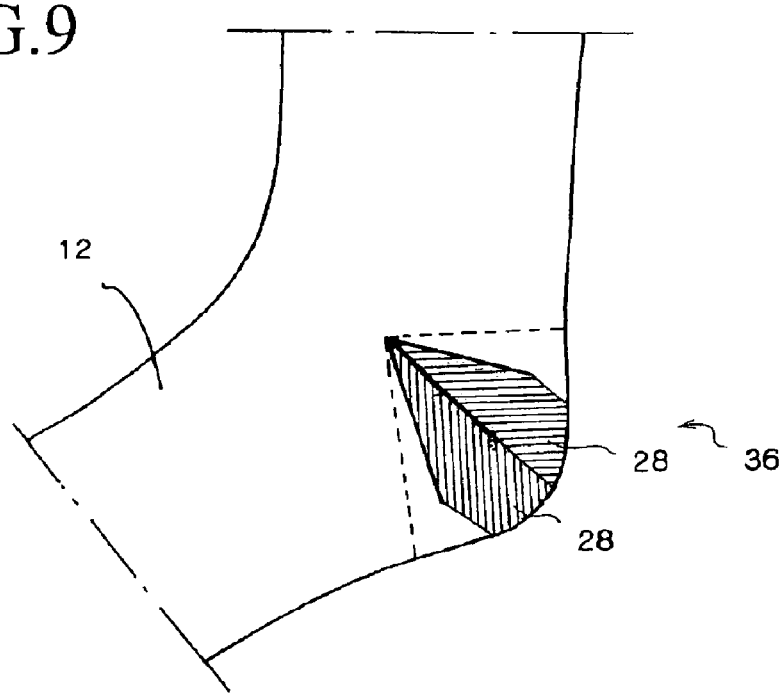
FIG. 9 is a partial perspective view of another example of the heel section of the modified sock for the left foot.
Figure 10:
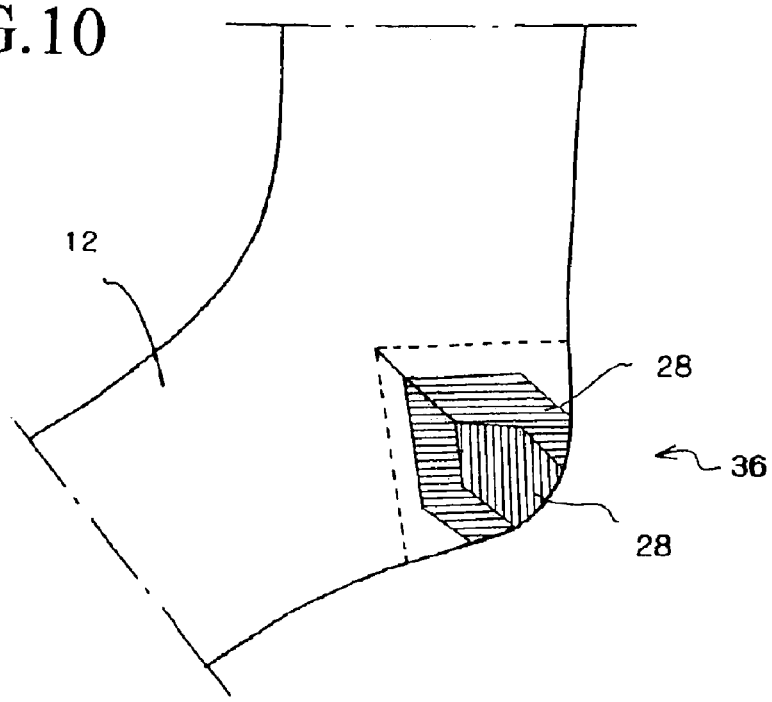
FIG. 10 is a partial perspective view of another example of the heel section of the modified sock for the left foot.
Figure 11:
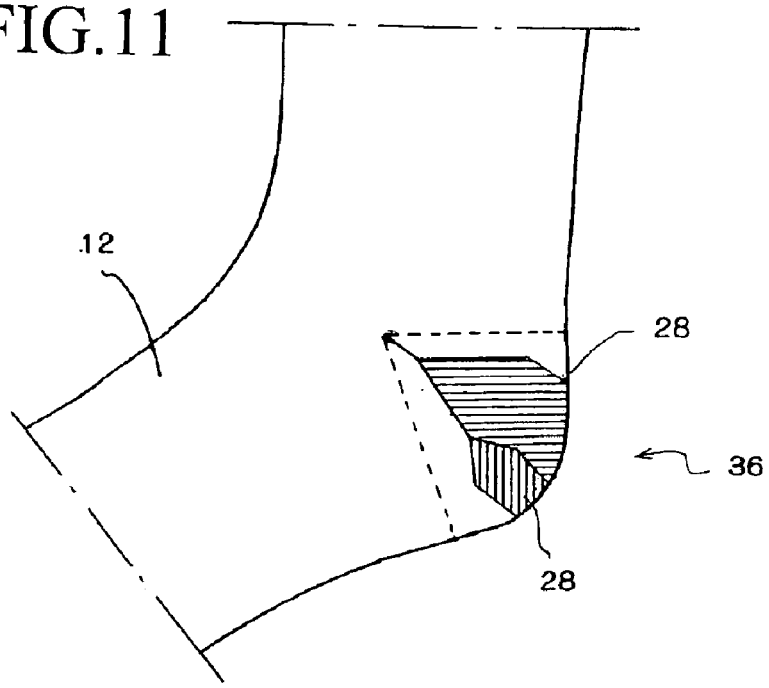
FIG. 11 is a partial perspective view of another example of the heel section of the modified sock for the left foot.

The shape of the third gusset part 28 may be designed according to a shape of a heel of a user who puts on the sock 10. For example, a plurality of V-shaped connected lines may be arranged as shown in FIG. 9 so as to arrange a plurality of third gusset parts 28 and 28, and a plurality of V-shaped connected lines may be serially formed as shown in FIG. 10 so as to form the third gusset part 28 in another third gusset part 28. Further, a V-shaped connected line is extended from one of front ends of another V-shaped connected line as shown in FIG. 11 so as to form a plurality of third gusset parts 28 and 28 like meshes.

By forming a plurality of third gusset parts 28, 28 . . . in the heel section 36, the shape of the heel section 36 can be corresponded to a shape of a heel of a user who puts on the sock 10, and bulge of one side of the heel section 36 can be larger than the other side of the heel section 36.

In the heel sections 36 of the socks 10 shown in FIGS. 8–11 too, when the heel section 36 is seen from the inner ankle side, the connected lines, which are formed by mutually tangling loops of the colth constituting a side part and a sole part of the heel section 36, can be seen as shown in FIG. 6B, but the V-shaped edges of the third gusset part 28 is not seen from the inner ankle side of the heel section 36.

In the above described embodiments, the socks are manufactured by the circular knitting machine, but they may be manufactured by a horizontal knitting machine.

The seam line 20 is formed in the instep part of the sock 10, but the seam line 20 may be formed in the sole part according to designs, further the sock 10 may be knitted without forming the seam line 20.

Note that, the sock 10 for the right foot or the left foot is determined by the tip toe section 14, or the tip toe section 14 and the heel section 36, so a mark for identifying for a right foot or a left foot may be attached to the sock 10.

FIGS. 6A–11 relate to the sock 10 having the tip toe section 14 shown in FIGS. 1A–1C, further the heel section 36 shown in FIGS. 6A–11 may be applied to a sock 100 shown in FIG. 12, which has a symmetrical tip toe section 104.

In the sock 100 having the heel section 36 shown in FIGS. 6A–11, the third gusset part 28 is formed in one side part of the heel section 36, and the heel section 36 has an asymmetrical shape; the third gusset part 28 is knitted nearer to one side of the heel section 36, so that an edge of the third gusset part 28 locates on the one side of the heel section 36 when the sock 100 is put on.

In the sock 100 having the heel section 36, when a person wearing the sock 100 walks, degree of tensing the cloth on the outer ankle side or the inner ankle side of the heel section 36 can be relieved, so that foot comfort of the sock 100 is better than that of the sock 100 shown in FIGS. 12, which has the symmetrical heel section 102, and damage of the cloth of the heel section 36 can be prevented. Namely, the foot comfort of the sock 100 having the heel section 36 shown in FIGS. 6A–11 is better than that of the conventional sock 100 shown in FIG. 12, which has the symmetrical tip toe section 104 and the symmetrical heel section 102.

Further, the heel section 36 shown in FIGS. 6A–11 may be applied to a sock 200 having a tip toe section 204 shown in FIGS. 14A–14C.

In the sock 200 having the heel section 36 shown in FIGS. 6A–11, a tip toe section 204 has an asymmetrical shape, in which a tip position G is located on the big toe side with respect to a center line X, a gusset part 220, which makes bulge of the tip toe section 204 on the big toe side larger than that of the little toe side, is knitted nearer to the big toe side of the tip toe section 204. Further, in the heel section 36 of the sock 200, the third gusset part 28 is formed in one side part of the heel section 36, and the heel section 36 has an asymmetrical shape; the third gusset part 28 is knitted nearer to one side of the heel section 36, so that an edge of the third gusset part 28 locates on the one side of the heel section 36 when the sock 200 is put on.

Therefore, in the sock 200 having the heel section 36 shown in FIGS. 6A–11, the shape of the tip toe section 204 is similar to that of a human foot whose big toe is thicker than other toes, and, degree of tensing the cloth on the outer ankle side or the inner ankle side of the heel section 36 can be relieved when a person wearing the sock 200 walks. Therefore, foot comfort of the sock 200, which has the heel section 36 shown in FIGS. 6A–11, is better than that of the sock 200 shown in FIGS. 14A–14C, which has the symmetrical heel section 26, and damage of the cloth of the heel section 36 of the sock 200 can be prevented.

In the above described embodiments, the hosiery is the sock whose length is designed to cover an ankle of a human foot, but the present invention can be applied to other hosiery, e.g., long socks, tights, stockings.

Industrial Applicability

In the hosiery of the present invention, the shape of the tip toe section is similar to that of a human foot, whose big toe is thicker and longer than other toes. Therefore, a force pressing the big toe toward other toes can be reduced as much as possible, so that pressure to the big toe and the little toe can be reduced.

Further, the cloth of the little toe side of the tip toe section is not slackened, so that foot comfort of the hosiery can be improved.

Therefore, the hosiery is proper for sports, in which a force is applied to the big toe, and effective for preventing deformation of the big toe and the little toe.

What is claimed is:

1. Asymmetrical hosiery knitted by a hosiery knitting machine, wherein a tip position of a tip top part is positioned nearer to a big toe side, comprising:

a first gusset part being knitted nearer to the big toe side of the tip toe section to be near a shape of a human foot having a big to thicker and longer than other toes so that a bulge of the tip toe section on the big toe side can be made larger than a bulge of a little toe side;

a second gusset part being knitted nearer to the big toe side following said first gusset part to extend the big toe side without substantially extending the little toe side of the tip toe section; and a front end part of the tip toe section being constituted by said second gusset part and a big toe side face of the tip toe section is constituted by said first gusset part and said second gusset part.

2. The hosiery according to claim 1, wherein edges of said first gusset part and said second gusset part form V-shaped lines, whose distance is gradually made longer toward a front end of the big toe side, when a big toe side of the tip toe section is seen from a side, and the edges forming the V-shaped lines are arranged toward a front end of the big toe side.

3. The hosiery according to claim 1, wherein an asymmetrical heel section includes a third gusset part positioned nearer to one side of the heel section, and an edge of said third gusset part locates on an inner ankle side or an outer ankle side at the one side of the heel section when the person wear said hosiery.

4. A method of manufacturing asymmetrical hosiery knitted by a hosiery knitting machine, wherein a tip position of a tip toe section is positioned nearer to a big toe side, comprising the following steps:

knitting a first gusset part by shifting the knitting direction toward a big toe side of the tip toe section; and knitting a second gusset part by shifting the knitting direction toward the big toe side of the tip toe section;

whereby said first gusset part is knitted nearer to the big toe side of the tip toe section so that a bulge of the tip toe section on the big toe side can be made larger than that of a little toe side, and said second gusset part is knitted nearer to the big toe side following said first gusset part so as to extend the big toe side without substantially extending the little toe side of the tip toe section.

5. The method according to claim 4, wherein said first gusset part and said second gusset part are knitted with changing number of actually knitting needles of the knitting machine.

6. Hosiery knitted by a hosiery knitting machine, wherein an asymmetrical heel section includes a gusset part positioned nearer to one side of the heel section, and an edge of said gusset part locates on an inner ankle side or an outer ankle side at the one side of the heel section when an individual wears said hosiery.

7. The hosiery according to claim 6, wherein edges of said gusset part substantially form V-shaped lines.

8. The hosiery according to claim 6, where mesh of knitted stitches of said gusset part of the heel section is larger than that of other parts thereof.

9. A method of manufacturing hosiery knitted by a hosiery knitting machine, comprising the step of:

knitting a heel section of the hosiery by shifting a knitting direction of the hosiery knitting machine toward an inner ankle side or an outer ankle side of the heel section;

whereby a gusset part is formed nearer to one side of the heel section and located on an inner ankle side or an outer ankle side of the heel section with the heel section being asymmetrically formed, and an edge of said third gusset part locates on an inner ankle side or an outer ankle side of the heel section when an individual wears said hosiery.

* * * * *